US005564877A

United States Patent [19]

Hamilton

[11] Patent Number: 5,564,877

[45] Date of Patent: Oct. 15, 1996

[54] LINER MACHINE FOR APPLYING SEALING COMPOUND TO CAN ENDS

[75] Inventor: David A. Hamilton, Abingdon, Va.

[73] Assignee: Reynolds Metals Company, Richmond, Va.

[21] Appl. No.: 370,701

[22] Filed: Jan. 10, 1995

[51] Int. Cl.[6] ..... B21D 51/46

[52] U.S. Cl. ..... 413/61; 413/20; 239/237; 118/DIG. 3

[58] Field of Search ..... 413/7, 18, 19, 413/20, 60, 61; 118/DIG. 3, 70, 320; 239/237, 240, 263, 263.1

[56] References Cited

U.S. PATENT DOCUMENTS

| | | | |
|---|---|---|---|
| 1,782,450 | 11/1930 | Taylor | 413/61 |
| 2,287,356 | 6/1942 | Newman | 113/80 |
| 3,876,144 | 4/1975 | Madden | 239/106 |
| 5,296,035 | 3/1994 | Chicatelli | 118/692 |
| 5,455,067 | 10/1995 | Chicatelli | 427/236 |

*Primary Examiner*—Jack W. Lavinder
*Attorney, Agent, or Firm*—Robert C. Lyne, Jr.

[57] ABSTRACT

A turret type liner machine for applying sealing compound to can ends, the machine including a novel mist spray system for delivering cleaning fluid against the sealant injector nozzles located at each turret station.

5 Claims, 2 Drawing Sheets

46
48
108
22
80
60
10
114
67
67
24
66
66
81
50
44
40
42
81
28
28
12
82
67
66
18
27
30
22
30
16
82
32
13
20
72
32
26

LINER MACHINE FOR APPLYING SEALING COMPOUND TO CAN ENDS

BACKGROUND OF THE INVENTION

This invention relates generally to a liner machine for applying a sealing compound to an article, and more particularly, to such a machine for applying a sealing compound to a can end.

This invention is especially directed to improving the operation of a prior art liner machine Model No. HSL6 sold by Preferred Machining Company of Englewood, Colo. That prior art liner machine includes a turret which rotates on a vertical spindle and has a number of work stations spaced around the spindle, each adapted to support a can end. Mounted at each station is an injector nozzle by which a sealing compound is applied to a can end, the sealing compound being fed to the injection nozzles from a supply manifold fixed to the top of the turret and receiving compound from a supply source via a Deublin rotary union. Can ends are fed into each station on one side of the turret, and discharged at an exit chute located approximately 180° from the feed position. After a station passes the exit chute, a mechanical brush mechanism wipes against the nozzle to clean any excess sealing compound from the surface of the nozzle. Not only does the brush mechanism fail to adequately clean the nozzle, but it becomes dirty and gummed up and requires frequent replacement, thereby causing substantial downtime of the machine.

In other prior art liner machines, for example, a similar turret machine sold some time ago by Crown Cork and Seal Co., the sealant injector nozzles are cleaned by spraying a cleaning fluid against the nozzles and that is a much more efficient system. In the Crown machine, the spindle for the turret is hollow and a feed conduit extends upwardly through the bottom open end of the spindle from a rotary union and connects to a series of fittings in the wall of the spindle which delivers cleaning fluid to each of the stations on the rotary turret.

In the more modem Preferred machine, it was not possible to use the cleaning fluid delivery system which was part of the Crown machine. The Preferred machine advantageously incorporates an electrical control assembly as part of the turret, and the housing for the assembly is coaxially mounted on top of a hollow support spindle, with electrical lines passing upwardly through the bottom open end of the spindle to the assembly. Thus, the Preferred machine incorporated the brush system for cleaning the sealant injector nozzles.

The problem addressed by applicant's invention was to replace the brush cleaning system provided in the standard Preferred machine with a more efficient spray mist cleaning system for the sealant injector nozzles.

SUMMARY OF THE INVENTION

Accordingly, the primary object of this invention is to provide a turret-type liner machine for applying sealing compound to can ends, the machine including a novel spray system for delivering cleaning fluid against the sealant injector nozzles located at each turret station.

Another object of the invention resides in the provision of the above novel liner machine in which the sealant compound is delivered to injector nozzles at each turret station from a supply coupling mounted on the upper end of the turret and rotatable therewith, and in which a manifold is rotatably mounted on the supply coupling for receiving cleaning fluid. The cleaning fluid is fed through a passageway formed in the wall of the supply coupling and then through separate conduit means to the spray nozzles located at each of the turret stations to spray cleaning fluid directly on the sealant injector nozzles located at each of those stations.

Still another object of the invention resides in the provision of the above novel liner machine wherein the manifold houses a bearing fixed on the wall of the supply coupling so that the manifold could be held stationary while the coupling rotates with the turret.

A further object of the invention resides in the provision of the above liner machine wherein the cleaning fluid introduced into the stationary manifold passes through the bearing and thereby lubricates the bearing.

Other objects and advantages of the invention will become apparent from reading the following detailed description of the claims in which reference is made to the accompanying drawings.

DETAILED DESCRIPTION OF THE INVENTION

Figure 1:
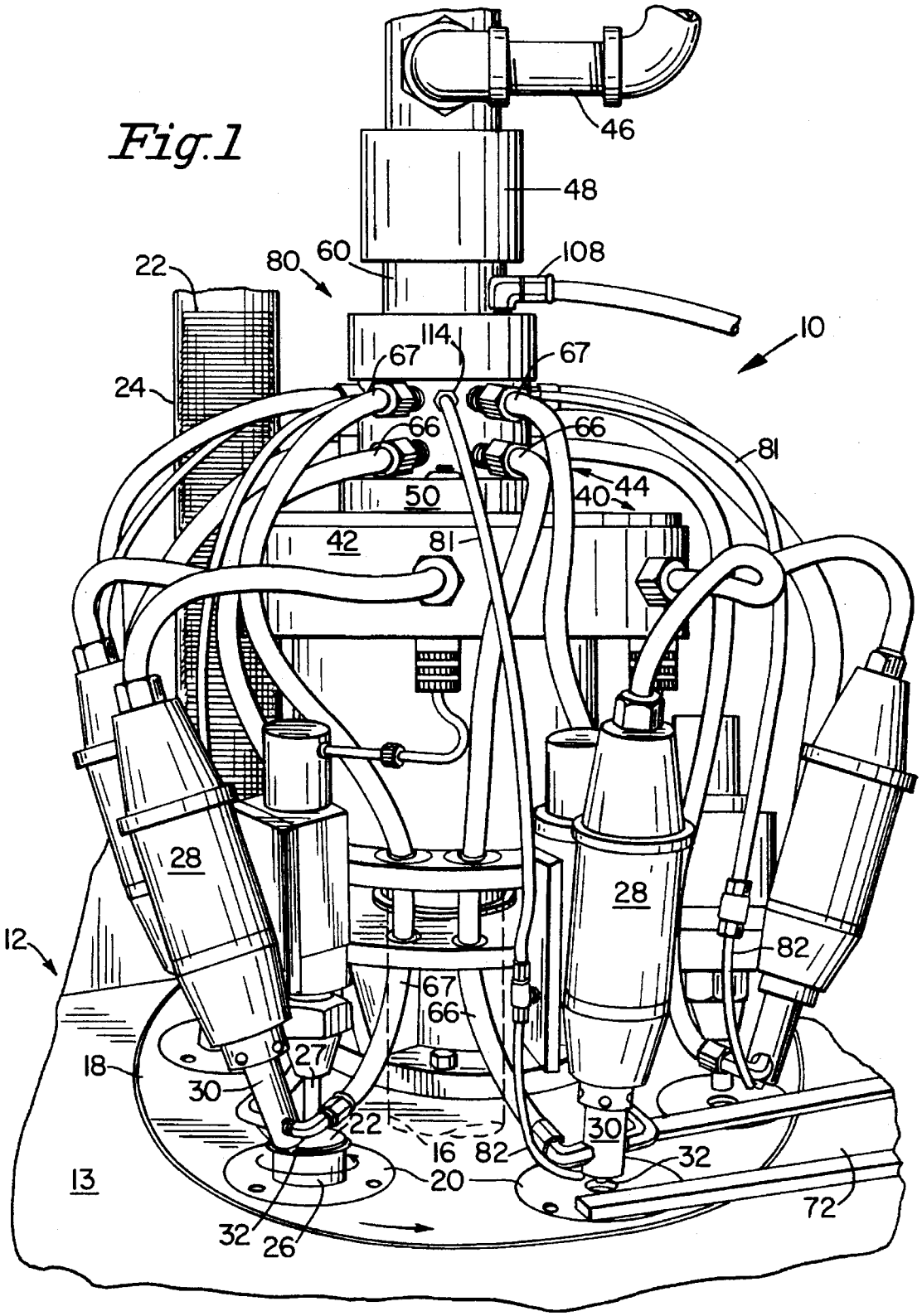
FIG. 1 is a schematic perspective representation of the turret-type liner machine of the invention.

Referring now to FIG. 1, the liner machine 10 includes a frame 12 and a rotary turret assembly 14 driven by a vertical spindle 16 which is rotatably mounted and driven within the lower portion of frame 12 underneath the horizontal bed 13. Turret assembly 14 includes a rotary table 18 fixed to spindle 16 and on which a plurality of angularly spaced work stations 20 are located. As turret assembly 14 is rotated, each work station receives a can end 22 from a can end feed position 24 located on one side of turret 14, the can end being deposited on a lower rotating chuck 26 which is raised and lowered vertically with respect to table 18 by a cam mechanism located underneath bed 13. With chuck 26 in its raised position, can end 22 is pinched between chuck 26 and an upper rotatable idler chuck 27.

An electrically operated injector gun 28 is located at each station 20 and includes a nozzle 30 having a tip 32 overlying the internal flange area of end cap 22 and spraying the sealing compound into that flange area as mandril 26 rotates.

Figure 2:
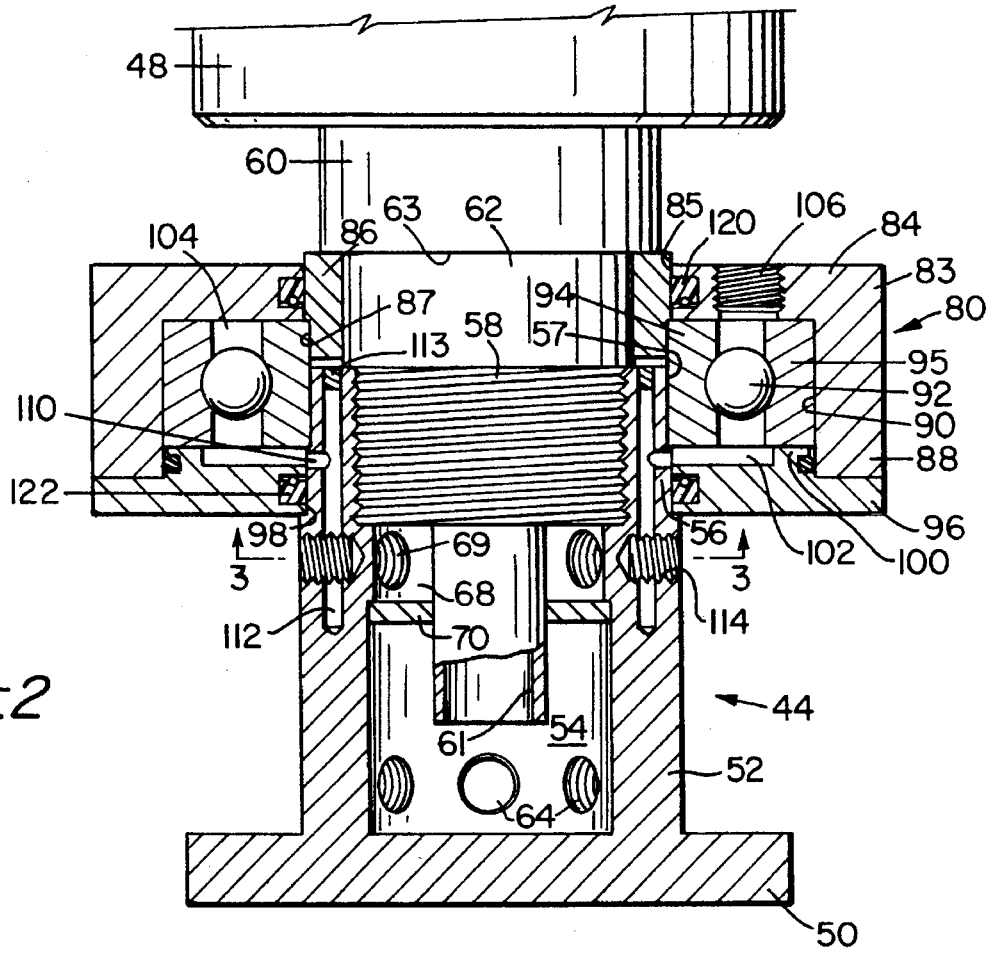
FIG. 2 is a partially fragmented sectional view of the novel coupling and manifold assembly by which sealant compound is delivered to the injector nozzles located at the various turret stations and by which cleaning fluid is delivered to each of those stations to clean each of the injector nozzles.
Figure 3:
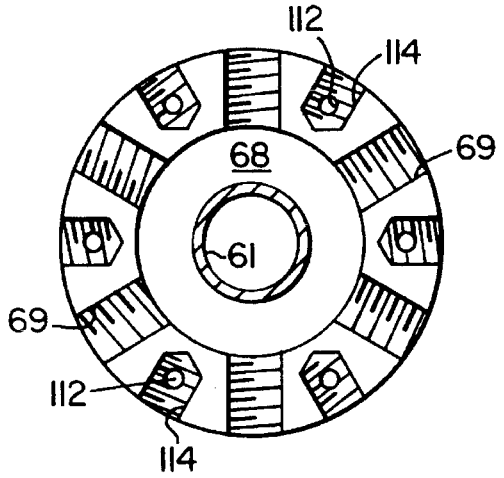
FIG. 3 is a sectional view taken generally along the line 3—3 of FIG. 2.

An electrical control assembly or brain bucket 40 includes a housing 42 which is fixed on table 18 for rotation therewith. A sealant compound supply coupling or manifold 44 is secured on top of housing 42 for rotation therewith and is connected to a supply source 46 for the sealant compound by way of a Deublin rotary union 48. As shown in FIG. 2, the supply coupling 44 has a bottom flange 50 which bolts to housing 42 and an upright cylindrical wall 52 defining a lower internal chamber 54, the reduced diameter upper end 56 of wall 52 being internally threaded to thread on the lower end 58 of the rotary output shaft 60 from union 48. A passageway 61 extends through output shaft 60 and delivers sealant compound from supply source 46 into chamber 54.

A plurality of holes 64 are drilled and tapped through wall 52 to receive fittings, each of which is connected to a flexible hose 66 which delivers the compound to one side of injector nozzle 30. Similar hoses 67 are connected to the other side of nozzle 30 to return sealant compound from the nozzles back to an upper chamber 68 by way of threaded openings 69 extending through wall 52. A partition 70 separates chambers 54 and 68.

Injector guns 28 include a solenoid operated needle valve which, when opened, permits the sealant compound to pass from conduit 66 into nozzle 30 and out through nozzle tip 32 onto the can end 22. When the needle valve is closed, the sealant compound will circulate from conduit 66 through nozzle 30, conduit 67, chamber 68, and back to the sealant supply source via rotary union 48 in conventional fashion.

During operation, as turret 14 rotates, a can end 22 is fed into a station 20 from feed position 24 adjacent one side of bed 13, and as table 18 continues to rotate, the can end 22 is coated with the sealing compound as described above and is discharged from the machine at the discharge station 72 located on the other side of the machine.

All of the structure described to this point is part of the prior art Preferred machine, Model No. HSL6, and the construction and operation of that machine is well known in the industry.

As noted initially hereinabove, applicant's invention is directed to a novel way by which spray mist cleaning fluid is delivered to each station 20 against the nozzle tips 32 to clean any excess sealing compound from those tips that might interfere with their normal operation. The novel cleaning system of the invention includes a supply manifold 80 which delivers cleaning fluid to hoses 81 and copper tubing 82 which spray the cleaning fluid against tips 32 at each station 20. Manifold 80 includes a cylindrical collar 83 having an end wall 84 with a central opening 85 that fits over the outer diameter of a cylindrical spacer 86 mounted on turned section 62 of shaft 60 and abutting shoulder 63. A cylindrical wall 88 extends downwardly from end wall 44 and defines a cylindrical bore 90 which receives a ball bearing 92. The upper end of wall section 56 and the lower end of sleeve 86 have reduced turned sections 57 and 87 and the inner race 94 of bearing 92 fits snug and is retained on those reduced sections.

A bottom cover plate 96 has a central opening 98 which fits around section 56 and is fastened to collar 83. Cover plate 96 has an annular flange 100 which pinches against the outer race 95 of bearing 92 to hold the outer race stationary within collar 93. Flange 100 also defines a chamber 102 communicating with the open cage area 104 of bearing 92. Cleaning fluid is fed to collar 83 via threaded opening 106 which is connected to a misting supply source via conduit 108.

An annular groove 110 is provided in the outer diameter of section 56 in communication with the chamber 102 and a plurality of passageways 112 extend axially in wall 52 in open communication with annular groove 110. Passageways 112 are drilled into wall 52 from its upper end face and the upper open end of those passageways are then suitably closed by plugs 113. A series of angularly spaced holes 114 are drilled and tapped into wall 52 intersecting passageways 112 in angular offset relationship with respect to openings 69. As shown in FIG. 1, spray conduits 81 are connected to openings 114.

A pair of annular seals 120 and 122 are provided at collar opening 85 and cover opening 98.

During operation of the machine, supply coupling 44 and output shaft 60 rotate with the turret, but manifold 80 is held stationary by the supply line 108. The spray mist solution from line 108 enters the manifold by opening 106, passes through the cage area 104 of bearing 92 to chamber 102 and into annular groove 110. From annular groove 110, the fluid is delivered to axial passageways 112, radial openings 114, conduits 81, and copper tubes 82, which then spray the fluid directly onto the sealant nozzle tip 32. It should be especially noted that the flow path for the cleaning fluid through manifold 80 and wall 52 of coupling 44 is totally separate from the flow path for the sealant compound through chamber 54, openings 64 and 70, and chamber 68.

Also during the operation of the machine, the control means 40 operates the injector guns 28 to supply the sealant compound to nozzles 30 only when at each station 20 a can end is in position to receive the sealant compound. When no can end is at a particular station 20, the compound is being returned to chamber 68 and is sent back to sealant supply through coupling 48 as described above. However, as long as can ends are available for supply to the turret table 18 from the supply station 24, control means 40 will maintain a continuous supply of spray misting solution to all the copper tubes 82 so that injector nozzle ends 32 are being continuously cleaned.

Thus it is apparent that the manifold 80 as described provides an efficient and economical means by which cleaning fluid is delivered to each of the stations 20 of the turret machine. In addition, when the cleaning solution is an oil based solution such as a heptane/white off mixture, it also serves to lubricate bearing 92 as it passes directly through the cage area 104 of the bearing. In applications where it may be necessary to use a water-based cleaning solution, it may be necessary to redesign the manifold somewhat so that the fluid would pass only through the collar 83 and/or cover plate 96 to passages 104 rather than directly through the bearing.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A liner machine for applying sealing fluid to can ends comprising:

a turret rotatable about a vertical axis and having a plurality of work stations circumferentially spaced around said axis, each station adapted to support a can end, first nozzle means mounted at each station for applying a sealing fluid to a can end, supply means connected to the upper end of said turret and rotatable therewith for supplying sealing fluid to said first nozzle means, said supply means having a tubular wall defining an internal chamber for receiving sealing fluid, first conduit means connected to said wall for delivering sealing fluid from said chamber to said first nozzle means, second nozzle means mounted at each station adjacent said first nozzle means for supplying cleaning fluid against said first nozzle means, a manifold rotatably mounted on said supply means for receiving cleaning fluid, fluid passage means extending from said manifold through said wall, and second conduit means connecting said fluid passage means with said second nozzle means.

2. The liner machine of claim 1, said manifold including bearing means mounted on said supply means permitting said manifold to remain stationary as said supply means rotates with said turret.

3. The liner machine of claim 2, said fluid passage means extending through said bearing means so that the cleaning fluid may also lubricate said bearing means.

4. The finer machine of claim 3, wherein said manifold receives an oil based cleaning fluid.

5. The liner machine of claim 1, comprising control means associated with said first conduit means for delivering sealing fluid to said first nozzle means at each station when a can end is in position to receive the sealing fluid, and control means associated with said second conduit means for continuously supplying cleaning fluid to said second nozzle means at each of said stations so long as can ends are being supplied to the machine.

* * * * *